US005494174A

United States Patent [19]

Rohr et al.

[11] Patent Number: 5,494,174

[45] Date of Patent: Feb. 27, 1996

[54] CONTAINER WITH REMOVAL RESISTANT CLOSURE

[75] Inventors: Robert D. Rohr, Eagle; Leo R. Imbery, Jr., Mukwonago, both of Wis.

[73] Assignee: AptarGroup, Inc., Crystal Lake, Ill.

[21] Appl. No.: 404,560

[22] Filed: Mar. 15, 1995

[51] Int. Cl.[6] ..... B65D 41/04

[52] U.S. Cl. ..... 215/330; 215/44; 215/331; 220/289

[58] Field of Search ..... 215/330, 44, 217, 215/218, 219, 331, 317, 263; 411/366, 308–311; 220/288, 289

[56] References Cited

U.S. PATENT DOCUMENTS

| | | | |
|---|---|---|---|
| 3,110,410 | 11/1963 | Pehr | 215/70 |
| 3,339,773 | 5/1966 | Stull | 215/40 |
| 3,435,978 | 1/1967 | Wittwer . | |
| 3,831,197 | 8/1974 | Stevens, Jr. | 215/329 |
| 3,951,289 | 4/1976 | Lenden | 215/211 |
| 4,034,882 | 7/1977 | Wright . | |
| 4,036,385 | 7/1977 | Morris | 215/221 |
| 4,098,419 | 7/1978 | Virog, Jr. et al. | 215/252 |
| 4,127,221 | 11/1978 | Vere | 222/153 |
| 4,134,513 | 1/1979 | Mumford | 215/216 |
| 4,273,248 | 6/1981 | Lehmann | 215/331 |
| 4,280,632 | 7/1981 | Yuhara | 215/331 |
| 4,310,101 | 1/1982 | Sekine | 215/331 |
| 4,349,116 | 9/1982 | Luenser | 215/330 |
| 4,353,475 | 10/1982 | Kachur et al. . | |
| 4,365,721 | 12/1982 | Montgomery | 215/217 |
| 4,454,965 | 6/1984 | Kirk, Jr. | 222/153 |
| 4,456,136 | 6/1984 | Palsson | 215/216 |
| 4,460,100 | 7/1984 | Libit | 215/237 |
| 4,597,501 | 7/1986 | Gueret . | |
| 4,763,801 | 8/1988 | Nycz | 215/203 |
| 4,799,597 | 1/1989 | Mayes et al. | 215/250 |
| 4,913,299 | 4/1990 | Petro | 215/330 |
| 4,940,168 | 7/1990 | Shadwell et al. | 222/153 |
| 4,991,733 | 2/1991 | Marino | 215/330 |
| 5,145,080 | 9/1992 | Imbery, Jr. | 215/331 |
| 5,279,434 | 1/1994 | Aguirrezabal . | |
| 5,360,127 | 11/1994 | Barriac . | |

FOREIGN PATENT DOCUMENTS

| | | | |
|---|---|---|---|
| 0011575 | 5/1980 | European Pat. Off. | 215/331 |

*Primary Examiner*—Allan N. Shoap
*Assistant Examiner*—Robin Hylton
*Attorney, Agent, or Firm*—Dressler, Goldsmith, Shore & Milnamow, Ltd.

[57] ABSTRACT

A removal resistant closure and container assembly is provided. The container defines an opening. The closure is applied to the container to occlude the opening. A first thread is defined by the container and extends at least partially around the opening from a leading end to a trailing end. A second thread is defined by the closure and extends at least partially around the closure form a leading end to a trailing end. A projection is defined adjacent one of the first and second threads. The projection and the one thread define a space between them which is less than the width of the other of the threads. Either the projection or the other thread, or both, are resilient to accommodate deformation during relative rotational movement of the container and closure. When the closure and container are screwed together, the threads are relatively axially displaced from a threadingly engaged condition to a disengaged condition which resists re-engagement.

15 Claims, 3 Drawing Sheets

CONTAINER WITH REMOVAL RESISTANT CLOSURE

TECHNICAL FIELD

This invention relates to a package in the form of an assembly of a container and removal-resistant closure thereon.

BACKGROUND OF THE INVENTION

AND

TECHNICAL PROBLEMS POSED BY THE PRIOR ART

A common type of container has a threaded neck and is adapted to receive a threaded closure in the form of a cap or the like. In many applications, such a closure is initially applied to a container by an automatic closure applying apparatus, such as a high-speed capping machine.

A variety of such threaded closures are provided with a dispensing feature, such as a lid body or base defining a dispensing orifice and a cooperating lid. The lid is disposed in the closure base and is adapted to be moved between (1) a lowered, closed position occluding the dispensing orifice and (2) an open position away from the dispensing orifice permitting the container contents to be discharged through the orifice.

A number of these types of closure designs include tamper-evident features which must be broken in order to first move the lid from the closed portion to the open position. However, if the closure base itself is easily removable from the container, then a tamperer could gain access to the container interior even though the tamper-evident feature between the lid and closure base is not broken or disturbed. It would therefore be desirable in some applications to prevent the easy removal of the entire closure from the container-even for those closures which have no tamper-evident feature.

Accordingly, it would be advantageous to provide an improved closure and container assembly wherein the closure cannot be easily removed. It would be especially desirable if such an improved design could be employed with a threaded system which would accommodate application of the closure to the container by means of a conventional, high-speed capping machine.

In addition, it would be advantageous if such an improved design would permit the closure to turn freely or rotate on the container, in either direction, after the closure has been properly mounted to the container. This would provide an indication to the user that the closure cannot be removed by the normal unscrewing motion, and this would therefore discourage attempts to remove the closure.

The present invention provides an improved container and mating closure system which can accommodate designs having the above-discussed benefits and features.

SUMMARY OF THE INVENTION

A package is provided according to the present invention which includes an assembly of a container and a removal resistant closure.

The unique package permits the closure to be applied to the container with a conventional, high-speed capping machine. The closure is securely held on the container in a way that prevents or significantly inhibits manual removal. Nevertheless, the closure can rotate freely in either direction of rotation on the container.

The container defines an opening, and the closure is applied to the container to occlude the opening. A suitable dispensing feature, such as a dispensing orifice and lid, can be provided in the closure.

The container defines a first thread which extends at least partially around the container opening from a leading end to a trailing end. A second thread is defined by the closure and extends at least partially around the closure from a leading end to a trailing end.

A projection is defined adjacent one of the first and second threads. The projection and one of the threads define a space between them which is less than the width of the other thread. The projection or the other thread, or both the projection and the other thread, are resilient to accommodate deformation during relative rotational movement of the container and closure when the container and closure are screwed together to mount the closure on the container. During this process, the threads are relatively axially displaced from a threadingly engaged condition to a disengaged condition which resists re-engagement.

In a preferred embodiment, the first and second threads each includes a helical portion. Further, the container includes a third thread with a leading end, a helical portion, and a trailing end, while the closure includes a fourth thread with a leading end, a helical portion, and a trailing end. The projection is defined by the third thread trailing end on the container. The third thread trailing end has a smaller angle than the first thread helical portion and converges with the first thread helical portion to define the space which is less than the width of the closure second thread.

In a typical application, the first and third threads on the container are each a male thread, and the second and fourth threads on the closure are each a female thread.

In the preferred embodiment, an additional projection is defined on the container by the first thread trailing end adjacent the third thread helical portion. The first thread trailing end has a smaller angle than the third thread helical portion and converges with the third thread helical portion. The first thread trailing end and the third thread helical portion define a space between them which is less than the width of the closure fourth thread.

Further, in the preferred embodiment, an additional projection is also defined by the fourth thread trailing end adjacent the second thread helical portion. The fourth thread trailing end has a smaller angle than the second thread helical portion and converges with the second thread helical portion. The fourth thread trailing end and the second thread helical portion define a space between them which is less than the width of the container first thread.

Finally, in the preferred embodiment, an additional projection is also defined by the second thread trailing end adjacent the fourth thread helical portion. The second thread trailing end has a smaller angle than the fourth thread helical portion and converges with the fourth thread helical portion. The second thread trailing end and the fourth thread helical portion define a space between them which is less than the width of the container third thread.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

DESCRIPTION OF THE PREFERRED EMBODIMENTS

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, the components of this invention are described in the normal (upright) operating position, and terms such as upper, lower, horizontal, etc., are used with reference to this position. It will be understood, however, that the components of this invention may be manufactured, stored, transported, used, and sold in an orientation other than the position described.

The closure of this invention may be applied to a container of this invention with a conventional, high speed capping machine, the details of which, although not fully illustrated or described, will be apparent to those having skill in the art and an understanding of the necessary functions of such machines. The detailed descriptions of such machines are not necessary to an understanding of the invention and are not herein presented because such machines form no part of the present invention.

Figure 1:
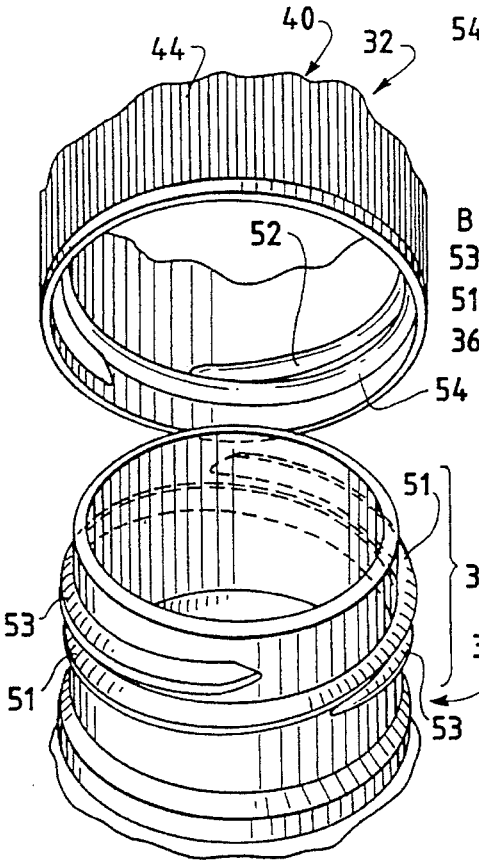
FIG. 1 is a fragmentary, perspective view of a preferred embodiment of the container and closure assembly of the present invention.

The present invention provides a package in the form of a container enclosure which incorporates a thread system for accommodating mounting of the closure on the container in a way that prevents easy removal of the closure. FIG. 1 illustrates the container designated generally by the reference number 30 and a closure designated generally by the reference number 32.

The closure 32 is adapted to be threadingly mounted on the container 30. The container 30 typically includes a body portion or a receptacle portion (not visible in the figures) which may have any suitable, special or conventional configuration and from which a neck 36 extends (as shown in FIG. 1). The neck 36 defines an opening through which the container contents can be dispensed.

As best illustrated in FIG. 1, the closure 32 includes a housing, base, or body 40 for securement to the container neck 36. The closure body 40 includes a peripheral wall in the form of a generally cylindrical skirt 44. Typically, the upper end of the closure skirt 44 is closed with, or merges with, a horizontal, transverse deck structure (not illustrated) which defines a suitable dispensing aperture or orifice. Typically, a lid (not illustrated) is mounted to the closure base 40 for movement between a closed position on the deck for occluding the orifice and an open position away from the deck to permit the container contents to be dispensed through the orifice.

The container neck 36 has a generally cylindrical configuration. The exterior surface of the neck 36 defines a first thread 51, and the closure skirt 44 defines, on its interior surface, a second thread 52. In the preferred embodiment illustrated, the container neck 36 also defines a third thread 53, and the closure skirt defines a fourth thread 54.

Although the container neck threads 51 and 53 are illustrated as exterior, male threads, and although the closure skirt threads 52 and 54 are illustrated as interior, female threads, it will be appreciated that the threads on the container neck could be female threads located on the inside of the container neck while the threads on the closure skirt could be male threads located on the outside of the closure skirt.

The container threads 51 and 53 each extends partially around the container neck 36 and together define a double lead thread system. Similarly, the closure skirt threads 52 and 54 each extends partially around the inside circumference of the skirt and together define a double lead thread system.

Figure 1A:
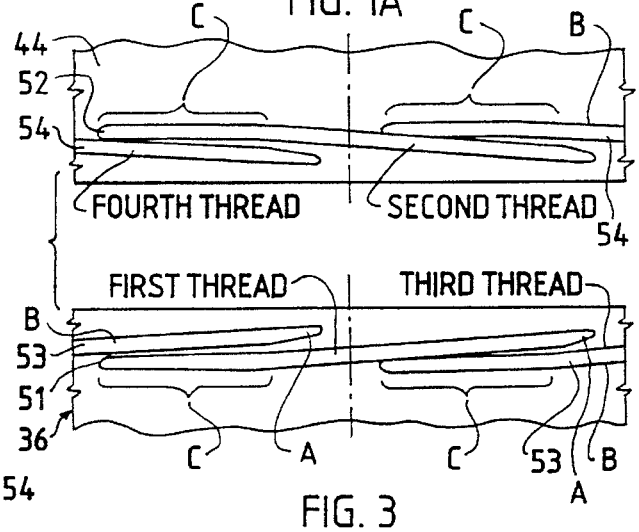
FIG. 1A is a developed view of the 360° cylindrical wall portions of the container and closure which contain threads, and the wall portions are shown in a flat orientation.
Figure 3:
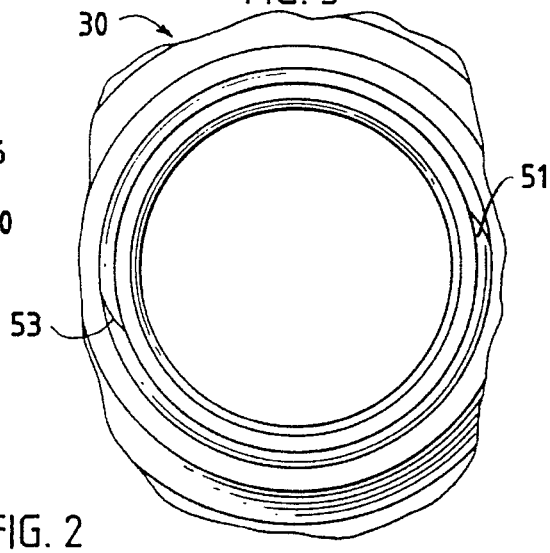
FIG. 3 is a fragmentary, top plan view of the container neck taken generally along plane 3—3 in FIG. 2.

Each thread 51, 52, 53, and 54 defines a leading end A, a helical portion B, and a trailing end C (FIG. 1A).

The leading end A of the container threads 51 and 53 is tapered on the side facing inwardly away from the end of the container. Similarly, the leading end A of the closure threads 52 and 54 is tapered on the side facing inwardly away from the open end of the closure skirt 44.

The side of each leading end A of the container threads 51 and 53 which faces toward the end of the container defines a helical surface extending partly around the container neck 36 and becomes part of the thread helical portion B. In a preferred embodiment, the helix angle is 3 degrees and 40 minutes. Similarly, the leading ends A of the closure threads 52 and 54 have a surface facing outwardly toward the open end of the closure, and that surface defines a generally helical angle which extends partly around the closure skirt and becomes part of the helical portion B of each thread. In the preferred embodiment, the helical portion B of the closure threads 52 and 54 has a helix angle of 3 degrees and 40 minutes.

As can be seen in FIG. 1A, the trailing end C of the container third thread 53 has a 0° helix angle and converges with the first thread helical portion B to define a space which is less than the width of the closure second thread 52. The trailing end C of the container third thread 53 may be alternatively characterized as functionally defining a "projection" on the container neck adjacent the first thread 51, and this projection defines, in cooperation with the first thread 51, the space which is less than the width of the closure second thread 52.

The trailing end C of the container first thread 51 similarly has a 0° helix angle and converges toward the helical portion B of the third thread 53. The first thread trailing end C may also be defined as a projection adjacent the first thread helical portion B.

Similarly, on the closure skirt, the trailing end C of the second thread 52 has a 0° helix angle and converges toward the helical portion of the fourth thread 54. Likewise, the trailing end C of the fourth thread 54 on the closure has a 0° helix angle and converges toward the helical portion B of the closure second thread 52. Each trailing end C of a thread may be regarded as a projection which, together with the helical portion B of the adjacent thread defines a reduced space which is less than the thread width.

It will be appreciated that the trailing end C of each thread does not necessarily have to be flat or have a 0° helix angle. However, the trailing end C must have an angle less than the helix angle of the helical portion B so as to converge toward the helical portion of the adjacent thread and define a reduced width space.

It will also be appreciated that in an alternative embodiment (not illustrated), the trailing ends C can be omitted and replaced with other suitable projections to define, in cooperation with the adjacent thread, a reduced space.

Figure 2:
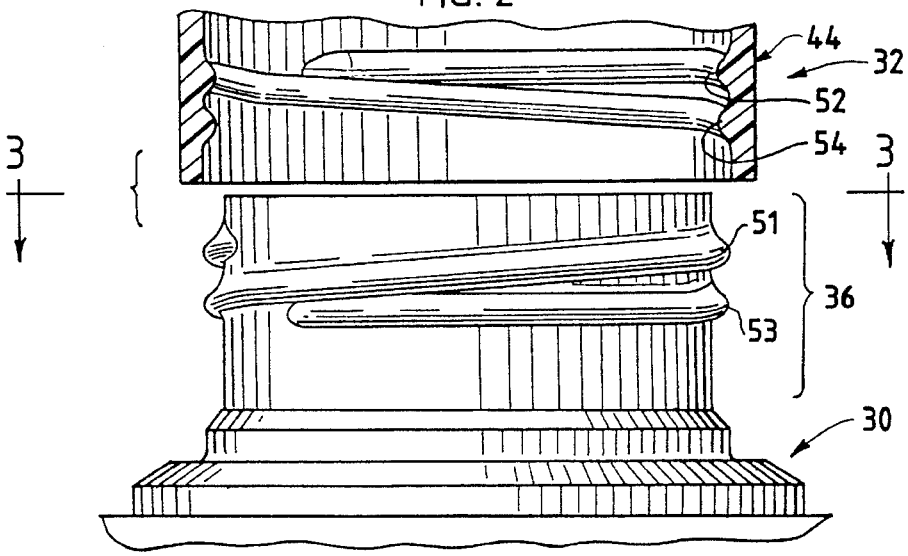
FIG. 2 is an enlarged, fragmentary, side elevational view of the container and closure prior to assembly.
Figure 4:
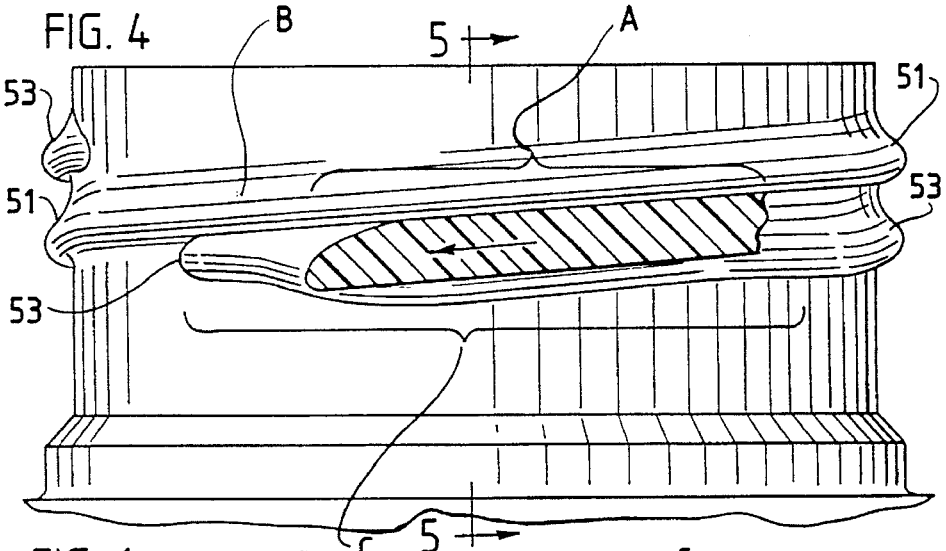
FIGS. 4, 6, and 8 are enlarged, fragmentary, partial cross-sectional views showing the operational sequence of screwing the closure onto the container.

FIG. 2 shows the closure 32 generally coaxially aligned with the container neck 36 just prior to moving the closure onto the container neck 36 and effecting a threaded engagement. FIGS. 4–8 sequentially illustrate the threading of the closure 32 onto the container neck 36. In FIG. 4, the closure second thread 52 has been threaded between the container threads 51 and 53. The leading end A of the closure second thread 52 has begun to move into the decreasing space defined by the 0° helical angle trailing end C of the container thread 53 and the helical portion B of the container thread 51.

Figure 5:
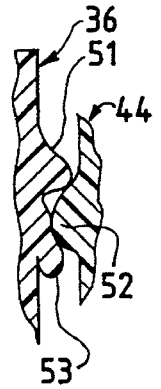
FIGS. 5, 7, and 9 are fragmentary, cross-sectional views taken generally along the planes 5—5, 7— 7, and 9—9 in FIGS. 4, 6, and 8, respectively.
Figure 6:
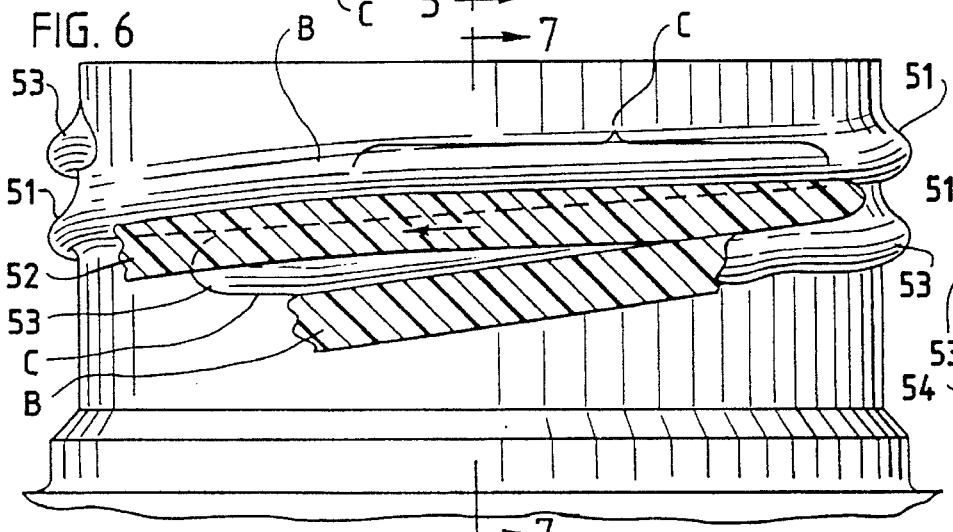
Figure 7:
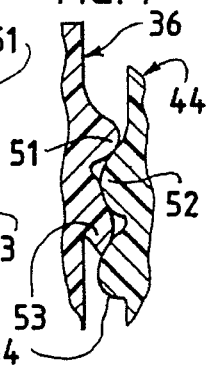

As shown in FIG. 5, the container thread 53 starts to deform somewhat. Depending upon the thread profile design and upon the materials employed, the closure thread 52 may also deform somewhat. Also, the closure skirt 44 may deflect slightly radially outwardly. In addition, there may be some upward deformation of the container thread 51. Preferably, the deformation is elastic and temporary.

At the point illustrated in FIGS. 4 and 5, the torque resistance to further threading engagement is starting to increase. Sufficient increased torque must be applied to continue the threading process and to further deform the threads.

As the closure is rotated further in the screwing-on, or engaging direction, the lower surface of the 0° helix angle trailing end C of the closure second thread 52 begins to engage the upper surface of the 0° helix angle trailing end C of the container thread 53. At the same time, the upper surface of the helical portion B of the closure thread 54 engages the lower side of the 0° helix angle trailing end C of the third thread 53 of the container. The rotational movement (in the screwing on direction) is resisted by the interference between these thread parts.

Figure 8:
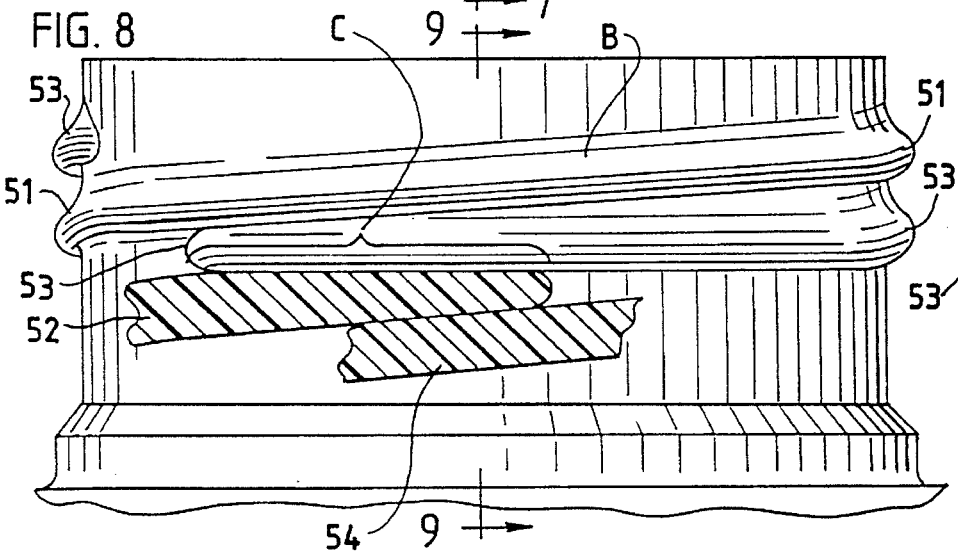
Figure 9:
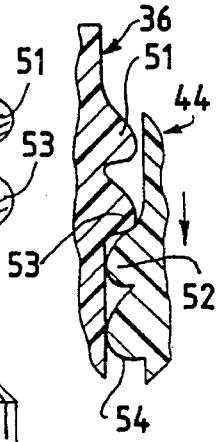

When the screwing on torque is increased sufficiently, the closure threads 52 and 54 move suddenly downwardly with somewhat of a snap action as the system undergoes sufficient deformation to accommodate the axial advancement of the closure in the screwing on direction. At that point, the closure threads 52 and 54 become positioned fully below the container threads 51 and 53 as illustrated in FIGS. 8 and 9. Further, as can be seen in FIG. 8, the 0° helix angle trailing portion C of the closure thread 52 is adjacent the bottom of the container thread 53.

With reference to FIGS. 4–9, it will be appreciated that the action of only one-half of the thread system is visible as the closure thread 52 snaps over and below the container thread 53. However, it will be understood that, at the same time, 180° around the container, the closure thread 54 is being snapped over and below the container thread 51. Thus, the 0° helix angle trailing end C of the closure thread 54 becomes located below, and adjacent, the bottom of the container threads.

Because the trailing ends C of the closure threads 52 and 54 have a 0° helix angle, and because the trailing ends C of the container threads 51 and 53 have a 0° helix angle, it is not possible to re-engage the threads by rotating the closure in an unscrewing direction. Consequently, once the closure 32 has been driven to the fully assembled position illustrated in FIGS. 8 and 9, the closure 32 merely rotates freely in the unscrewing direction (as well as in the screwing on direction).

In a presently contemplated, preferred embodiment, the thread pitch (i.e., the distance between the helical portions of two adjacent threads) is 0.125 inch. The thread system has a 0.25 inch lead (i.e., the theoretical distance that the closure would move axially if it was rotated one 360° revolution on the thread system).

In the preferred embodiment illustrated in FIGS. 1–9, a double lead thread system is employed. Thus, the container includes two threads, threads 51 and 53, and the closure includes two threads, threads 52 and 54. It will be appreciated, however, that other thread combinations are possible. For example, a single thread could be provided on the closure, and a single mating thread could be provided on the container. However, the use of a double lead thread system permits the threading forces to be balanced 180° apart, and this provides more effective control during the threading process.

With the double lead thread system of the preferred embodiment, the combined length of the leading end A and helical portion B of each thread is 205°, and the trailing end C (along a 0° angle) has an arc length of 90°. With this configuration, the closure need be rotated only about 295° in order to drive the closure threads completely past the container threads to the fully mounted position illustrated in FIG. 8.

In the illustrated preferred embodiment having a double lead thread and wherein each thread has a 0° angle trailing end C, the minimum length of the trailing end C is determined by the formula 360°/[2 × (number of leads)].

The novel thread system of the present invention permits application of the closure by a high-speed capping machine with torques which are relatively low compared to other closure/container attachment structures, such as bayonet, bead type configurations or ratchet type configurations. Nevertheless, despite the relatively low application torque required for the present invention, the closure and container remain attached in a manner that prevents the typical user from manually removing the closure from the container.

Figure 10:
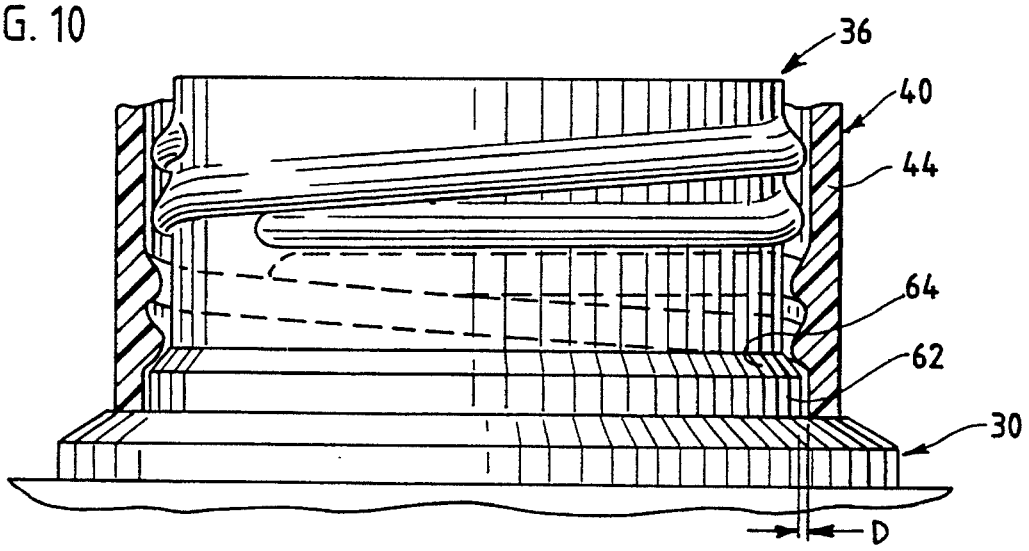
FIG. 10 is a fragmentary, cross-sectional view of the closure and container of FIGS. 1–9 showing the closure fully assembled on the container.

FIG. 10 illustrates the closure base 40 mounted on the neck 36 of the container 30 in a fully assembled condition wherein the closure threads are disengaged from, and positioned below, the container threads. In the embodiment illustrated in FIG. 10, the container includes a shoulder 62 at the base of the neck 36, and the top of the shoulder 62 has a frustoconical surface 64 merging with the neck 36.

The threads on the closure base 40 are located inwardly from the bottom, open end of the closure base 40 so as to accommodate the shoulder 62 and frustoconical surface 64. As illustrated in FIG. 10, there is a small, annular space D between the exterior surface of the shoulder 62 and the interior surface of the closure base 40. This space is sufficient to accommodate normal manufacturing tolerances, but is small enough to prevent significant lateral movement of the closure base 40 on the bottle neck 36. This inhibits efforts to cock the mounted closure and re-engage the threads in an attempt to unscrew the closure.

Figure 11:
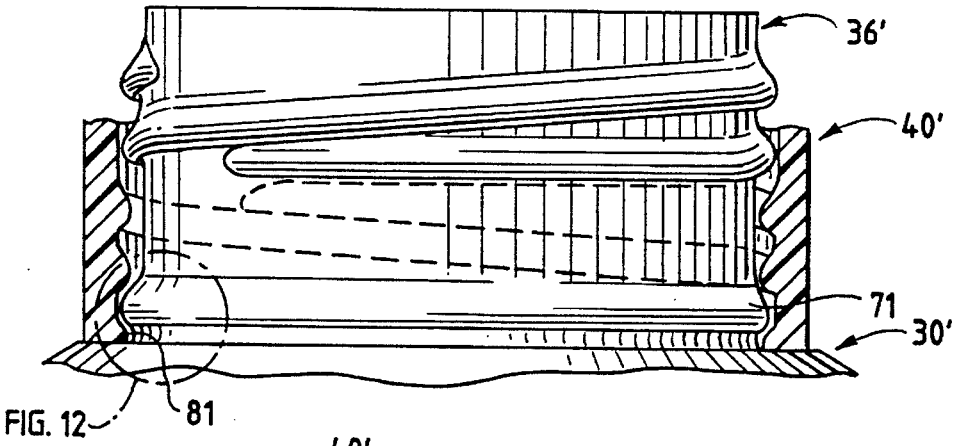
FIG. 11 is a view similar to FIG. 10, but FIG. 11 shows a second embodiment.
Figure 12:
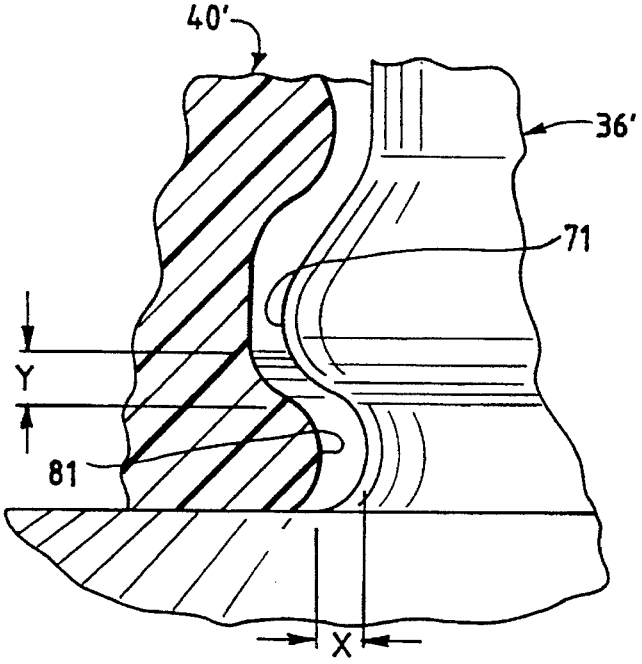
FIG. 12 is a greatly enlarged, fragmentary view of the area within the broken line circle designated "FIG. 12" in FIG. 11.

An alternate embodiment of the package of the present invention is illustrated in FIGS. 11 and 12. FIGS. 11 and 12 illustrate a closure base 40' fully assembled on the neck 36' of a container 30' with the threads of the closure base 40' located below the threads of the container neck 36'. A double lead thread system is shown in the embodiment illustrated in FIGS. 11 and 12, and this double lead thread system is identical with that described above with reference to the embodiment illustrated in FIGS. 1–10.

The alternate embodiment in FIGS. 11 and 12 includes a special centering bead 71 located near the base of the neck 36'. The bead 71 is designed to reduce the capability of the closure base 40' to be angled or cocked on the container neck 36'. Such cocking of the closure base 40' might otherwise make it somewhat easier to attempt to force the threads into engagement when a simultaneous unscrewing torque is applied. The centering bead 71 resides below the leading ends of the closure threads, and the bead 71 prevents the closure threads from being tilted or moved radially inwardly a significant amount.

Further, the closure base 40' also preferably includes a shallow bead 81 around the bottom, interior periphery of the closure skirt. The bead 81 is located vertically below the container centering bead 71. As illustrated in FIG. 12, there is a lateral, or radial, clearance x between the container neck 36' and the closure bead 81. There is also a vertical clearance y between the top of the closure bead 81 and the container centering bead 71. The clearances x and y are sufficient to accommodate manufacturing tolerances, but are small enough to prevent significant lateral or vertical movement. This prevents any significant tilting or cocking of the closure base 40' on the container neck 36'. This minimizes the likelihood that the threads can be forced into engagement in an attempt to unscrew the closure.

It will be appreciated that the closure bead 81 must be forced or snapped over the container neck centering bead 71 by the axial driving force imparted to the closure base 40' during the application of the closure to the container neck. Removal of the closure would initially require a substantial amount of vertical force which is difficult to provide manually with this embodiment because the closure threads are not readily engageable with the container threads.

The container and closure assembly of the present invention may be molded from suitable thermoplastic materials, such as polypropylene and the like. The invention can be embodied in closures and containers produced with conventional manufacturing operations which do not require excessively high or close tolerances. The closure and container components of the present invention accommodate assembly with conventional capping machines and provide a package that inhibits or resists closure removal.

It will be readily apparent from the foregoing detailed description of the invention and from the illustrations thereof that numerous variations and modifications may be effected without departing from the true spirit and scope of the novel concepts or principles of this invention.

What is claimed is:

1. A removal resistant closure and container assembly comprising:

a container defining an opening;

a closure for being applied to said container to occlude said opening;

a first thread defined by said container and extending at least partially around said opening from a leading end to a trailing end;

a second thread defined by said closure and extending at least partially around said closure from a leading end to a trailing end; and a projection defined adjacent one of said first and second threads, said projection and said one thread defining a space between them which is less than the width of the other of said threads, and at least one of said projection and said other thread being resilient to accommodate deformation during relative rotational movement of said container and closure when said closure and container are screwed together whereby said threads are relatively axially displaced from a threadingly engaged condition to a fully closed disengaged condition which resists re-engagement.

2. The assembly in accordance with claim 1 in which said first thread and said second thread each includes a helical portion.

3. The assembly in accordance with claim 2 in which said first thread is a male thread such that the male thread is received inside said closure.

4. The assembly in accordance with claim 2 in which said container includes a third thread with a leading end, a helical portion, and a trailing end; and said closure includes a fourth thread with a leading end, a helical portion, and a trailing end.

5. The assembly in accordance with claim 4 in which said projection is defined by said third thread trailing end on said container, said third thread trailing end having a smaller angle than said first thread helical portion and converging with said first thread helical portion to define said space which is less than the width of said closure second thread.

6. The assembly in accordance with claim 5 in which an additional projection is defined by said first thread trailing end adjacent said third thread helical portion, said first thread trailing end and said third thread helical portion defining a space between them which is less than the width of said closure fourth thread, said first thread trailing end having a smaller angle than said third thread helical portion and converging with said third thread helical portion.

7. The assembly in accordance with claim 5 in which an additional projection is defined by said fourth thread trailing end adjacent said second thread helical portion, said fourth thread trailing end and said second thread helical portion defining a space between them which is less than the width of said container first thread, said fourth thread trailing end having a smaller angle than said second thread helical portion and converging with said second thread helical portion.

8. The assembly in accordance with claim 5 in which an additional projection is defined by said second thread trailing end adjacent said fourth thread helical portion, said second thread trailing end and said fourth thread helical portion defining a space between them which is less than the width of said container third thread, said second thread trailing end having a smaller helix angle than said fourth thread helical portion and converging with said fourth thread helical portion.

9. The assembly in accordance with claim 4 in which said first, second, third, and fourth helical portions each has an arc length of about 205° and has a helix angle of between 3° and 4° and said first, second, third, and fourth thread trailing ends each has an arc length of about 90° and has a 0° helix angle.

10. The assembly in accordance with claim 4 in which said closure second and fourth thread trailing ends each has an angle less than the helix angle of said second and fourth thread helical portions.

11. The assembly in accordance with claim 1 in which said container has a neck defining said opening; and a shoulder is defined around the bottom of said neck for engaging a part of said closure when said closure is cocked on said neck so as to minimize the amount of cocking.

12. The assembly in accordance with claim 1 in which said container includes a neck;

said container includes a centering bead on said neck below said container first thread; and said closure defines a bead at the bottom of said closure for riding over and snapping below said container centering bead when said closure and container are screwed together and said threads are relatively axially displaced from a threadingly engaged condition.

13. A removal resistant closure and container assembly comprising:

a container having a neck defining an opening;

a closure for being applied to said container to occlude said opening, said closure having an open end for being disposed adjacent said container neck;

a first thread defined by said container and extending at least partially around said opening from a leading end to a trailing end;

a second thread defined by said closure and extending at least partially around said closure from a leading end to a trailing end;

a third thread defined by said container and extending at least partially around said opening from a leading end to a trailing end;

a fourth thread defined by said closure and extending at least partially around said closure from a leading end to a trailing end;

each said thread defining a helical portion between said leading end and trailing end;

said trailing end of each said thread on said container being located axially further away from said container opening than said leading end of each said thread on said container;

said trailing end of each said thread on said closure being located axially further away from said closure open end than said leading end of each said thread on said closure;

each said thread trailing end having a smaller angle than the helix angle of said helical portion;

said third thread trailing end converging with said first thread helical portion to define a space between them which is less than the width of said closure second thread;

said first thread trailing end converging with said third thread helical portion to define a space between them which is less than the width of said closure fourth thread;

said fourth thread trailing end converging with said second thread helical portion to define a space between them which is less than the width of said container first thread;

said second thread trailing end converging with said fourth thread helical portion to define a space between them which is less than the width of said container third thread; and said threads being resilient to accommodate deformation during relative rotational movement of said container and closure when said closure and container are screwed together whereby said threads are relatively axially displaced from a threadingly engaged condition to a fully closed disengaged condition which resists re-engagement.

14. The assembly in accordance with claim 13 in which said first, second, third, and fourth helical portions each has an arc length of about 205° and has a helix angle of between 3° and 4°; and said first, second, third, and fourth thread trailing ends each has an arc length of about 90° and has a 0° helix angle.

15. The assembly in accordance with claim 13 in which said first and third threads are male threads such that the male threads are received inside said closure.

* * * * *